US005265380A

United States Patent [19]

Datum et al.

[11] Patent Number: 5,265,380

[45] Date of Patent: Nov. 30, 1993

[54] CUP GRINDING MACHINE, IN PARTICULAR FOR GRINDING SCISSORS PARTS

[75] Inventors: Klaus Datum; Gerhard Hoeller, both of Solingen, Fed. Rep. of Germany

[73] Assignee: E. Siepmann & Co. (GmbH & Co), Solingen, Fed. Rep. of Germany

[21] Appl. No.: 922,720

[22] Filed: Jul. 31, 1992

[30] Foreign Application Priority Data

Aug. 2, 1991 [DE] Fed. Rep. of Germany ..... 4125654

[51] Int. Cl.[5] ..... B24B 49/00

[52] U.S. Cl. ..... 51/165.87; 51/165.77; 51/165.74

[58] Field of Search ..... 51/165.87, 165.71, 165.74, 51/165.76–165.77, 165.78, 165.79

[56] References Cited

U.S. PATENT DOCUMENTS

| | | | |
|---|---|---|---|
| 1,566,744 | 12/1925 | Gray . | |
| 2,633,678 | 4/1953 | Smith | 51/122 |
| 4,071,980 | 2/1978 | Kubo | 51/165.87 |
| 4,535,570 | 8/1985 | Ochiai et al. | 51/165.87 |
| 4,679,358 | 7/1987 | Sieradzki | 51/165.87 |
| 4,869,025 | 9/1989 | Hill et al. | 51/122 |
| 4,989,376 | 2/1991 | Armond et al. | 51/165.71 |
| 5,097,632 | 3/1992 | Yamamori et al. | 51/165.87 |

FOREIGN PATENT DOCUMENTS

| | | |
|---|---|---|
| 96043 | 4/1972 | Fed. Rep. of Germany . |
| 2331770 | 1/1975 | Fed. Rep. of Germany . |
| 2419249 | 3/1979 | Fed. Rep. of Germany . |
| 3636314 | 5/1987 | Fed. Rep. of Germany . |
| 651491 | 9/1985 | Switzerland . |

*Primary Examiner*—Bruce M. Kisliuk
*Assistant Examiner*—Eileen P. Morgan
*Attorney, Agent, or Firm*—Browdy and Neimark

[57] ABSTRACT

The invention relates to a cup grinding machine for grinding oblong workpieces with a grinding device with a cup grinding wheel rotationally drivable about an axis of rotation and a workpiece receiver, which comprises a clamping device for retaining the workpiece during the grinding process with a longitudinal direction of the workpiece being angled approximately at 90° to the axis of rotation of the cup grinding wheel and which is displaceable in relation to the cup grinding wheel in a plane (x-y-plane), which is parallel to the axis of rotation of the cup grinding wheel and of the longitudinal direction of the workpiece by means of guidance devices. The guidance devices are formed on the one hand by a first guidance slide, on which the grinding device is displaceably supported in a feed direction (y-direction) which is parallel to the axis of rotation of the cup grinding wheel, and on the other hand by a second guidance slide, on which the workpiece receiver is displaceably supported in a direction (x-direction) extending in right angles to the axis of rotation of the cup grinding wheel.

4 Claims, 2 Drawing Sheets

CUP GRINDING MACHINE, IN PARTICULAR FOR GRINDING SCISSORS PARTS

FIELD OF THE INVENTION

The invention relates to a cup grinding machine for grinding oblong workpieces, in particular for grinding scissors parts, knife blades, cutting tools with a grinding device with a cup grinding wheel rotationally drivable about an axis of rotation and a workpiece receiver, which comprises a clamping device for retaining the workpiece during the grinding process with a longitudinal direction of the workpiece being angled to the axis of rotation of the cup grinding wheel.

BACKGROUND OF THE INVENTION

A cup grinding machine of this type is known for instance from U.S. Pat. No. 4,869,025. With this machine the workpiece receiver is displaceable in relation to the cup grinding wheel by means of guidance devices in an x-y-plane, which is parallel to the axis of rotation of the cup grinding wheel and of the longitudinal direction of the workpiece. The guidance devices are formed by a first (x-)slide disposed on a guidance, which is secured in stationary manner to the machine frame and by a second (y-)slide, which is displaceable on a guidance, which extends in right angles to the guidance of the first (x-)slide and which is fixed on the latter. Both slides consequently form a so-called compound slide, the movement of which in y-direction serve for feeding the workpiece against the cup grinding wheel and the movement of which in x-direction serve for moving the workpiece past the grinding surface of the grinding wheel.

The axis of rotation of the cup grinding wheel is stationary during grinding, i.e. it is not fed to the scissors part during grinding. A readjustment compensating for wear of the grinding surfaces, however, is possible between two grinding processes. For this purpose the grinding device is displaceably supported parallel to the axis of rotation of the cup grinding wheel—i.e. in y-direction. Readjustment of the grinding device for compensating the wear of the grinding surfaces is performed via a costly measurement control, with the help of which wear is determined and the grinding device is readjusted in y-direction in such a manner that during grinding the grinding surface is always located in a desired position with regard to the y-direction.

High structural expenses represent a disadvantage of the known grinding machine, which is caused on the one hand by the compound slide per se and on the other hand by the additional displacement support of the grinding device for wear compensation. Furthermore it is desirable to improve the manufacturing accuracy, which can be attained with the known grinding machine on the basis of the coupling of the degrees of free movement of the workpiece receiver in x- and y-direction by means of the compound slide.

SUMMARY OF THE INVENTION

It is an object of the invention to embody a grinding machine in such manner that it is simplified with view to design and to machine requirements while retaining its possibilities for application with view to grinding requirements and while improving the processing accuracy which can be attained by the grinding machine.

This object is attained in accordance with the invention by providing the cup grinding machine with a first guidance slide, on which the grinding device is displaceably supported along its maximum possible feed path exclusively in a feed direction, which is parallel to the axis of rotation of the cup grinding wheel, with a second guidance slide, on which the workpiece receiver is displaceably supported exclusively in a direction extending in right angles to the axis of rotation of the cup grinding wheel and with a sensor for compensating the wear of the grinding surfaces of the cup grinding wheel, by means of which the feed position of the grinding device with respect to the feed direction can be determined at a fixed position of the grinding surface with respect to the sensor position and this feed position can be assigned to a feed control device as a reference position for the feed control of the grinding device.

Accordingly the guidance devices for the relative displacement of the cup grinding wheel and of the workpiece receiver to each other is not anymore formed by a common compound slide, on which the workpiece receiver is arranged; what is more is that these guidance devices are realized in detached manner from one another in the form of simple guidance slides, which are assigned to the grinding device or the workpiece receiver respectively. By the decoupling of the two guidance slides, which now are not anymore superposed, but which are displaceably supported each directly at the machine frame, the expenses with regard to design reduce considerably, as for example the drive and the energy supply to the drive motors simplify. Also by this design an improvement of the processing accuracy can be attained, as in contrast with the compound slide tolerances in the movement of one slide do not transfer to the other slide.

A further advantage of the solution according to the invention is based on the fact that by the support displaceable in feed direction (y-direction) of the grinding device simultaneously a basis is created for integrating the wear compensation of the grinding surfaces into the feed displacement of the grinding device, which is of benefit also to the processing accuracy. For this purpose a sensor is provided, by means of which the feed position of the grinding device with respect to the feed direction (y-direction) can be determined at a fixed distance, given by the apparatus, of the grinding surface to the sensor position, and by means of which this feed position can be assigned to the feed control device as a reference position for the feed control of the grinding device. This means that the sensor may be for example a light barrier or infrared distance measurement sensor, which measures in contactless manner. As soon as the grinding surface blocks the light barrier or is located at a fixed distance to the infrared distance measurement sensor, exactly this feed position is delivered to the feed control device as a reference position for the feed control of the grinding device, which for example is performed with a computerized numerical control means in a manner, in which the coordinate value is set to zero at this defined feed position.

With the change of coordinates in feed direction fixed in the grinding program of the CNC grinding machine the cup grinding wheel with its grinding surface is always moved into a defined working position, which is independent from wear and in which the measurement changes, which are caused by wear, of the cup grinding wheel are compensated in feed direction. The y-slide consequently serves for compensating wear and for the y-feeding during the grinding process; this means that it has a double function.

According to a preferred embodiment of the cup grinding machine according to the invention it is provided, that the sensor is formed by a stop sensing element with a stop tracer, which projects into the feed path of the cup grinding wheel, whereby the feed position of the grinding device can be assigned to the feed control device as a reference position when the grinding surface of the cup grinding wheel abuts on the stop tracer. This indicates an embodiment of the sensor, which is especially simple with regard to design. Surprisingly, the claimed stop measurement sensing element is suitable as a sensor, although the stop tracer of which and the grinding surface contact one another during abutment and thus wear of the stop tracer would actually be expected. However, by a corresponding equipment of the contact surface of the stop tracer for instance with a ceramic or hard metal plate and by a corresponding short contact time between the grinding wheel and the tracer, its wear can be kept within such narrow bounds, that the wear compensation of the grinding surfaces is not significantly affected within the limits of the permitted processing tolerances in the range of a few hundredth millimeters.

According to further embodiment of the cup grinding machine according to the invention it is provided that the stop sensing element or its stop tracer can be removed from the feed path of the cup grinding wheel after the grinding surface abuts on the stop tracer. In this way the feed path of the cup grinding wheel to the working position at the workpiece is made free.

According to a further preferred embodiment of the cup grinding machine a computerized numerical control means is provided as a feed control device for the guidance slides of the workpiece receiver or the grinding device. Thus with the help of the guidance slide for the grinding device in y-direction not only the feed of the cup grinding wheel to the workpiece can be performed, but also the grinding of curved parts by a corresponding superimposed triggering of the two guidance slides and thus a corresponding path control in the x- and y-direction for grinding-in curves at knives, scissors or the like can be performed. This means that with the help of the computerized numerical control means different functions can be integrated into the displacement control of the guidance slide of the grinding device, namely the actual feed of the cup grinding wheel to the workpiece, a compensation for wear and, in combination with a path control in x-direction via the guidance slide of the workpiece receiver, the grinding of a curve.

Further features, details and advantages of the invention will become apparent from the ensuing description of one example of embodiment of the subject matter taken in conjunction with the drawing.

DESCRIPTION OF THE PREFERRED EMBODIMENTS

Figure 1:
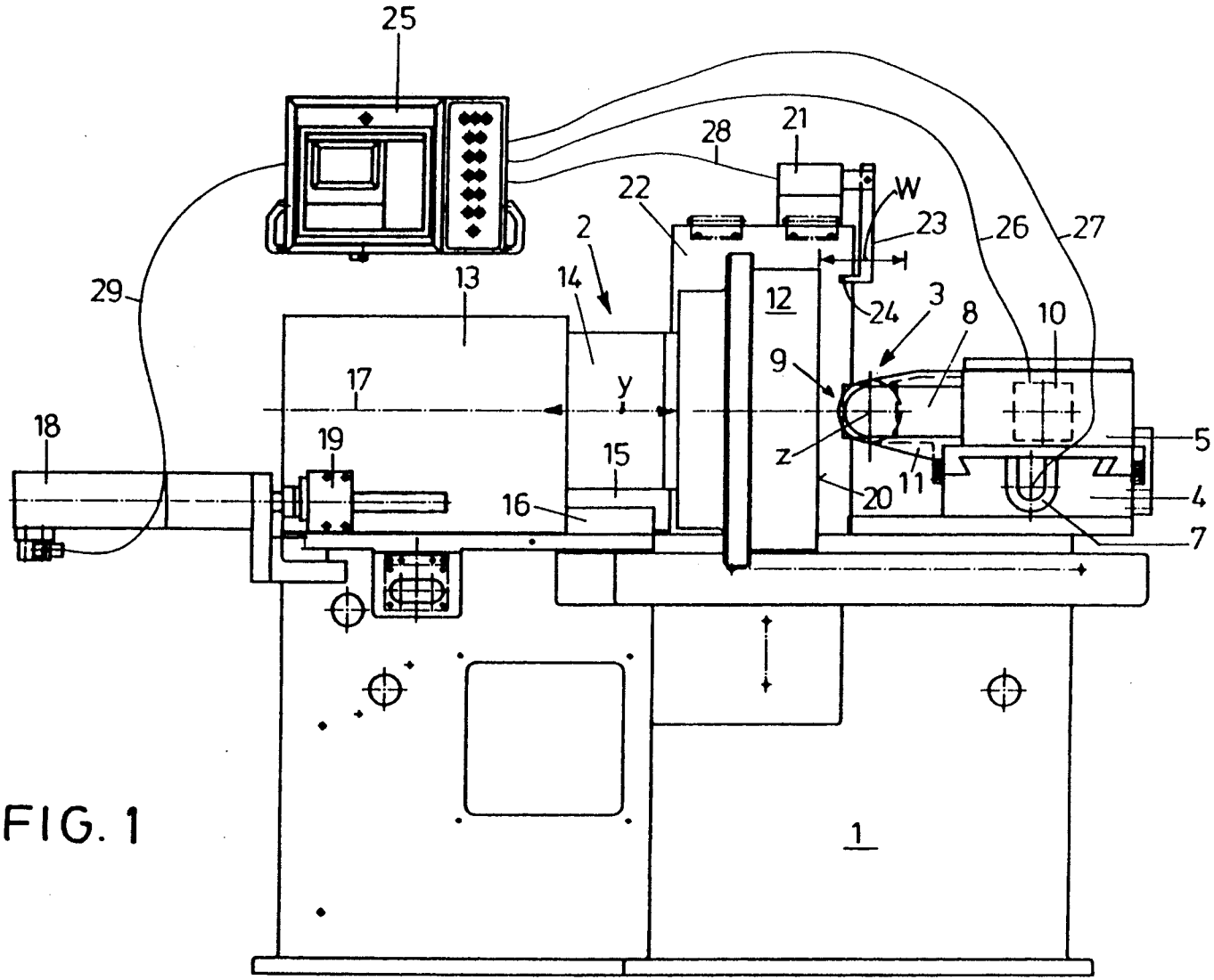
FIG. 1 shows a grinding machine according to the invention in longitudinal view and FIG. 2 shows a plan view onto this grinding machine.

The computerized numerically controlled grinding machine shown in the drawings comprises a machine frame 1, onto which substantially a grinding device 2 as well as a workpiece receiver 3 are arranged.

Figure 2:
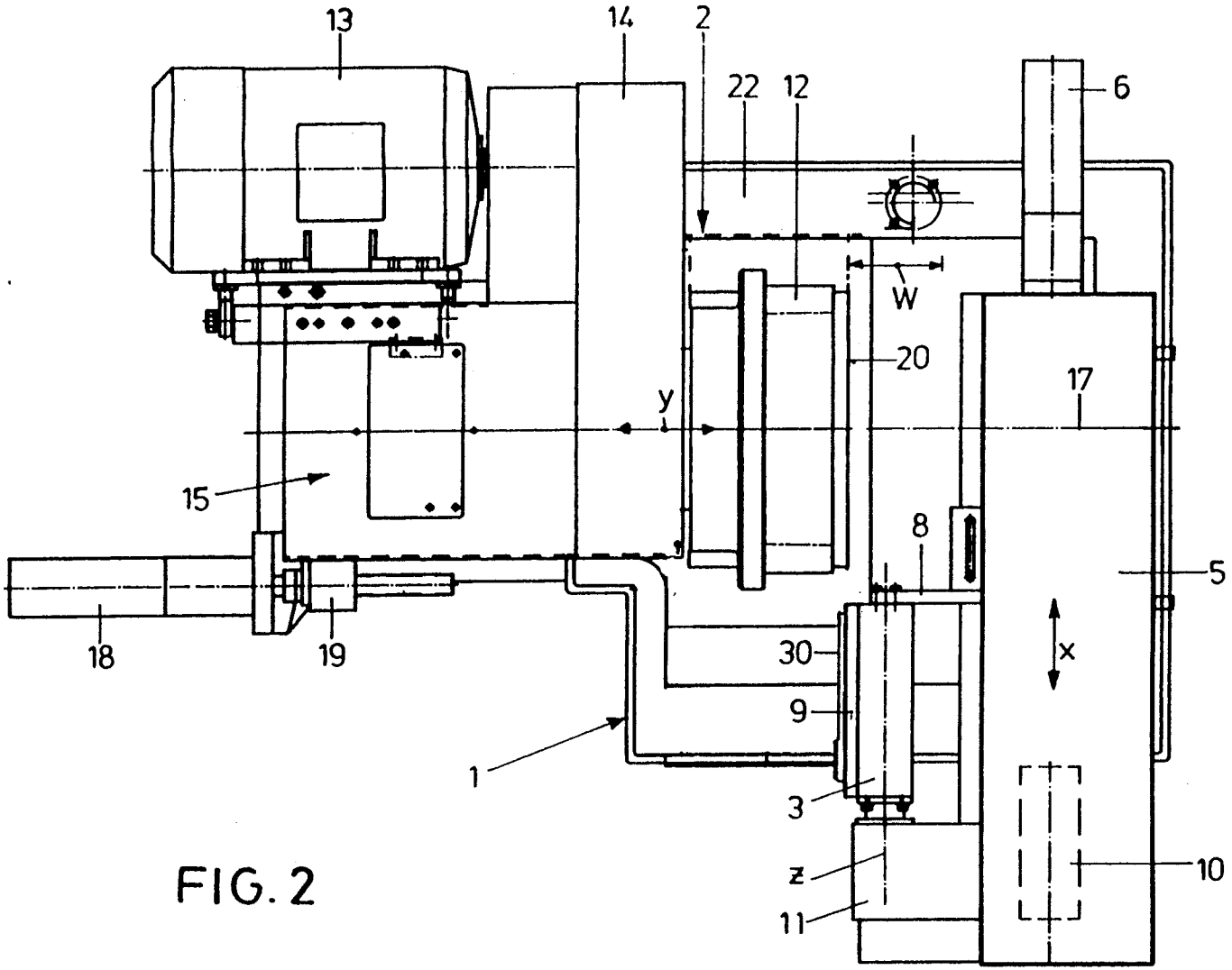

The workpiece receiver 3 is supported longitudinally displaceable via an x-slide 5—namely according to the definition in x-direction—on a guidance 4, which is disposed in stationary manner on the machine frame 1. The displacement drive of the slide is performed by means of a motor 6 via a spindle drive 7 shown diagrammatically in FIG. 1. Cantilevered arms 8 project from the x-slide 5, of which cantilevered arms 8 only one can be seen in FIG. 2. At these cantilevered arms 8 the workpiece receiver 3 with its clamping device 9 (shown diagrammatically) for the workpieces to be ground, e.g. a scissors part 30 (FIG. 2) is tiltably supported. The tilt axis (z-axis) extents parallel to the x-direction of the displacement movement of the slide 5. The tilt drive of the workpiece receiver 3 is performed by means of a motor 10, which is disposed at the slide 5, via a corresponding gear unit, which is accommodated in the housing 11, which is shown in FIG. 2 and which projects from the slide 5. The precise embodiment of the clamping device 9 is not essential for the subject matter of the present invention. A clamping device can be used as is described in detail in U.S. Pat. No. 4,869,025.

The grinding device 2 located opposite to the workpiece receiver 3 with its cup grinding wheel 12, its drive motor 13 for the rotational movement of the cup grinding wheel 12 and its encapsulated belt gear unit 14 is disposed on a further y-slide 15, which is supported longitudinally displaceable on a guidance 16, which is also secured in stationary manner to the machine frame 1, transversely to the direction of displacement (x-direction) of the workpiece receiver 3. The direction of displacement (y-direction) and the axis of rotation 17 of the cup grinding wheel 12 extend parallel to each other in this case. The displacement drive is performed by means of a further motor 18, which is supported at the machine frame 1, via a spindle drive 19.

By the respective guidance of the grinding device 2 or the workpiece receiver 3 in y- or x-direction, these machine parts are displaceable in relation to each other in an x-y-plane, which is defined by these directions of diplacement. Thus by the displacement movement of the grinding device 2 in y-direction the feed motion of the cup grinding wheel 12 is effected into the grinding position, which varies constantly during a grinding process, whereas by the displacement movement of the workpiece receiver 3 in x-direction during the grinding process the workpiece to be ground is moved past the front-ended, ring-shaped grinding surface 20 of the cup grinding wheel 12. By the tiltability of the workpiece receiver 3 about the z-axis, which is parallel to the x-y plane, skewed workpiece surfaces or the like can be manufactured on this occasion.

The grinding surface 20 of the cup grinding wheel 12 is subject to wear, which must be compensated by appropriate measures, in order to attain the necessary processing accuracy. For this purpose a sensor for compensating the wear of the grinding surfaces is provided in form of a stop sensing element 21, which is disposed on a bearing block 22, which laterally of the machine frame 1 projects upwards (FIG. 1). The stop sensing element 21 comprises a tiltable stop tracer 23 in the form of an extension arm, which protrudes in right angles into the feed path W of the cup grinding wheel 12. The free end 24 of the stop tracer 23, which is bent parallel to the axis of rotation 17 of the cup grinding wheel 12, is covered with a ceramic or hard metal plate, in order to keep wear of the free end 24 within as narrow as possible bounds.

The stop sensing element 21, as well as the motors 6, 10, 18, is connected with the central computerized numerical control means 25, in which different grinding programs are stored for processing different workpieces, such as scissors parts, knife blades or the like. In accordance with a respective grinding program the different motors 6, 10, 18 are triggered, in order to produce a corresponding shape of the workpiece by a corresponding relative movement of cup grinding wheel 12 and workpiece in the x-y-plane and about the z-axis.

The grinding machine has the following mode of operation in particular with respect to the function of the stop sensing element 21:

After completion of a grinding operation a workpiece disposed at the workpiece receiver 3 has moved out of the active grinding section. While the workpiece is exchanged man h an automatic feeding device, as it is described for example in U.S. Pat. No. 4,869,025, the grinding device 2 is moved while being triggered by the computerized numerical control means 25 from the starting position shown in the drawings in y-direction to the stop tracer 23 of the stop sensing element 21. Before, the stop tracer 23 was tilted to the feed path W of the grinding surface 20. As soon as the grinding surface 20 abuts on the free end 24 of the stop tracer 23, this is detected by the stop sensing element 21 and a corresponding electrical signal is fed to the computerized numerical control means 25 via a standard input. This implies that the stop position of the cup grinding wheel 12 is defined as a reference position for the further accomplishment of the grinding program for example by a reset of the y-component value, which is registered at this moment in the computerized numerical control means. Starting from this reference position the cup grinding wheel 12 thus moves always into a precisely defined processing position in relation to the workpiece at the clamping device 9 by the feed motion of the grinding device 2.

In order to assure only a contact which is as short as possible between the grinding surface 20 and the free end 24 of the stop tracer 23 and to assure free accessability of the cup grinding wheel 12 to the workpiece, the stop sensing element 21 is designed such that immediately after the grinding surface 20 of the cup grinding wheel 12 abuts on at the stop tracer 23 the latter is tilted away in upwards direction. Simultaneously the grinding device 2 can be moved back by a reversal of rotation of the motor 18. After the tilting away of the stop tracer 23 the grinding device moves into the position given by the control programm in quick motion for grinding-in a further workpiece secured in the meantime at the workpiece receiver 3. The x-slide 5, which has been moved synchronously in quick motion into a starting position with respect to the grinding process, afterwards in the grinding operation moves out again into the feeding position shown in FIG. 2. The described operation repeats with a new workpiece. The wear compensation of the grinding surfaces controlled via the grinding program stored in the CNC-grinding device can be performed either after each grinding operation or only after accomplishing a certain number of grinding operations. A criterion for this decision is the fact, whether wear relevant for the required processing accuracy appears already after one or only after several grinding operations.

What is claimed is:

1. Cup grinding machine for grinding oblong workpieces, in particular for grinding scissors parts, knife blades, cutting tools and the like comprising a grinding device (2) with a cup grinding wheel (12) rotationally drivable about an axis of rotation (17), a workpiece receiver (3), which comprises a clamping device (9) for retaining the workpiece (30) during the grinding process with a longitudinal direction of the workpiece being angled to the axis of rotation of the cup grinding wheel.

a first guidance slide (15), on which the grinding device (2) is displaceably supported along its maximum possible feed path (W) exclusively in a feed direction (y-direction), which is parallel to the axis of rotation (17) of the cup grinding wheel (12), a second guidance slide (5), on which the workpiece receiver (3) is displaceably supported exclusively in a direction (x-direction) extending in right angles to the axis of rotation (17) of the cup grinding wheel (12), and a sensor (21) for compensating wear of the grinding surfaces of the cup grinding wheel (12), by means of which the feed position of the grinding device (2) with respect to the feed direction (y-direction) can be determined at a fixed position of the grinding surface (20) with respect to the sensor position and this feed position can be assigned to a feed control device (25) as a reference position for the feed control of the grinding device (2), wherein the sensor is formed by a stop sensing element (21) having a stop tracer (23), said stop tracer (23) projecting into the feed path (W) of the cup grinding wheel (12), whereby the feed position of the grinding device (2) can be assigned to the feed control device (25) as a reference position when the grinding surface (20) of the cup grinding wheel (12) abuts on the stop tracer (23).

2. Cup grinding machine according to claim 1, wherein the stop sensing element (21) can be removed from the feed path (W) of the cup grinding wheel (12) after the grinding surface (20) abuts on its stop tracer (23).

3. Cup grinding machine according to claim 1 wherein the stop tracer (23) of the stop sensing element (21) can be removed from the feed path (W) of the cup grinding wheel (12) after abutment of the grinding surface (20).

4. Cup grinding machine according to claim 1, comprising a computerized numerical control means (25), which serves as a feed control device for the guidance slides (5, 15) of the workpiece receiver (3) and of the grinding device (2) respectively.

* * * * *